US011022925B2

(12) United States Patent
Yamamoto et al.

(10) Patent No.: US 11,022,925 B2
(45) Date of Patent: Jun. 1, 2021

(54) POST-PROCESSING APPARATUS

(71) Applicant: TOSHIBA TEC KABUSHIKI KAISHA, Tokyo (JP)

(72) Inventors: Mikio Yamamoto, Izunokuni Shizuoka (JP); Yoichi Yamaguchi, Gotemba Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 159 days.

(21) Appl. No.: 16/513,775

(22) Filed: Jul. 17, 2019

(65) Prior Publication Data

US 2020/0233360 A1 Jul. 23, 2020

(30) Foreign Application Priority Data

Jan. 23, 2019 (JP) ..... JP2019-009648

(51) Int. Cl.
*G03G 15/00* (2006.01)
*B41L 43/12* (2006.01)

(52) U.S. Cl.
CPC ..... *G03G 15/55* (2013.01); *B41L 43/12* (2013.01); *G03G 15/6541* (2013.01)

(58) Field of Classification Search
CPC ..... B41L 43/12; B65H 2511/521; B65H 2407/10; B65H 2553/822
See application file for complete search history.

(56) References Cited

U.S. PATENT DOCUMENTS

2005/0240376 A1* 10/2005 Uwatoko ..... H04N 1/00015 702/183
2011/0031675 A1 2/2011 Terao
2011/0031677 A1 2/2011 Ozawa
2013/0175752 A1* 7/2013 Ishikawa ..... B65H 33/08 270/58.08
2014/0153013 A1 6/2014 Imamura
2018/0314200 A1* 11/2018 Yokoyama ..... G03G 15/553

FOREIGN PATENT DOCUMENTS

JP 06-345319 12/1994
JP 10-35985 2/1998
JP 2004043037 A * 2/2004
JP 2009-007095 1/2009
JP 2014-169160 9/2014

OTHER PUBLICATIONS

Extended European Search Report for European Patent Application No. 19191207.0 dated Mar. 25, 2020.

* cited by examiner

*Primary Examiner* — Jennifer E Simmons
(74) *Attorney, Agent, or Firm* — Amin, Turocy & Watson, LLP

(57) ABSTRACT

According to one embodiment, a post-processing apparatus includes a first sensor, a second sensor, and a control unit. The first sensor detects an object in a predetermined area in which a predetermined post-process is performed on a sheet conveyed from an image forming apparatus. The second sensor detects an object at a position closer to an opening in the area than the position of the first sensor with respect to the opening through which the sheet passes when the post-processed sheet is discharged from the area. When the second sensor detects an object before the first sensor detects the object, the control unit performs a predetermined process for preventing the occurrence of a failure.

20 Claims, 7 Drawing Sheets

POST-PROCESSING APPARATUS

CROSS-REFERENCE TO RELATED APPLICATIONS

This application is based upon and claims the benefit of priority from Japanese Patent Application No. 2019-009648, filed Jan. 23, 2019, the entire contents of which are incorporated herein by reference.

FIELD

Embodiments described herein relate generally to a post-processing apparatus and post-processing methods.

BACKGROUND

A post-processing apparatus performs a post-process on a sheet conveyed from an image forming apparatus. For example, the post-process is stapling. The post-processed sheet is discharged from an opening. When an object enters the opening, the post-processing apparatus may fail. However, in the post-processing apparatus, the occurrence of a failure is not prevented when an object enters the opening.

DETAILED DESCRIPTION

Embodiments provide a post-processing apparatus capable of preventing the occurrence of a failure when an object enters an opening of the post-processing apparatus.

In general, according to one embodiment, a post-processing apparatus includes a first sensor, a second sensor, and a control unit. The first sensor detects an object in a predetermined area in which a predetermined post-process is performed on a sheet conveyed from an image forming apparatus. The second sensor detects an object at a position closer to an opening in the area than a position of the first sensor with respect to the opening through which the sheet passes when the post-processed sheet is discharged from the area. When the second sensor detects an object before the first sensor detects the object, the control unit performs a predetermined process for preventing the occurrence of a failure.

According to another embodiment, a post-processing method involves detecting an object at a first position in an area of a post-processing apparatus in which a predetermined post-process is performed on a sheet conveyed from an image forming apparatus; detecting the object at a second position closer than the first position to an opening in the area, the opening is an opening through which the sheet passes when the post-processed sheet is discharged from the area; and performing a predetermined process for preventing an occurrence of a failure when the object is detected at the second position before the object is detected at the first position.

Hereinafter, a post-processing apparatus of an embodiment will be described with reference to the drawings.

Figure 1:
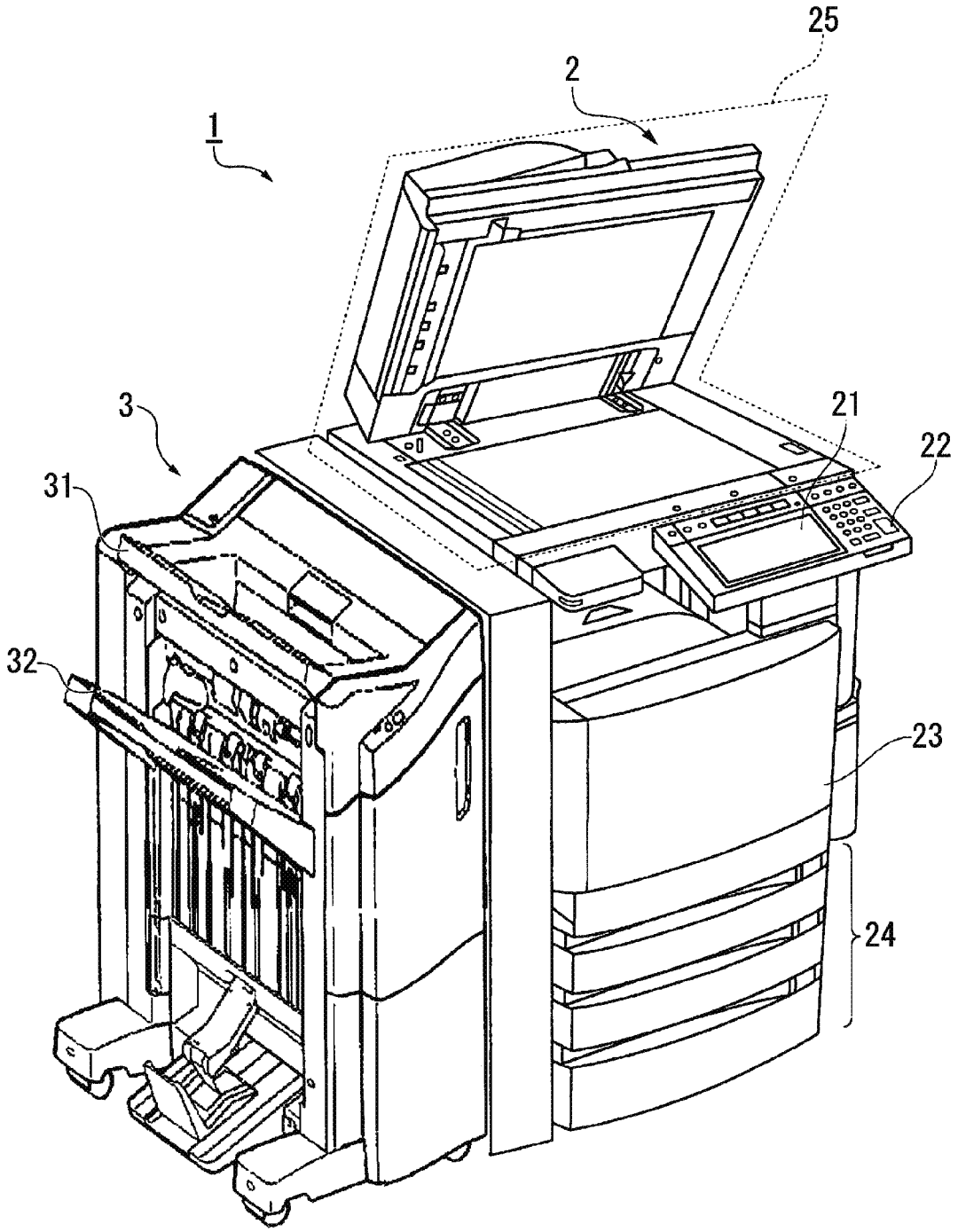
FIG. 1 is an external view showing an example of the overall configuration of an image forming system according to an embodiment.

FIG. 1 is an external view showing an example of the overall configuration of an image forming system 1 according to an embodiment. The image forming system 1 includes an image forming apparatus 2 and a post-processing apparatus 3. The image forming system 1 is a system for forming an image on a sheet-like recording medium. The image forming system 1 performs a post-process on a sheet-like recording medium. The post-process is, for example, sorting, stapling, or the like.

The image forming apparatus 2 is, for example, a multi-function peripheral or a printing apparatus. The image forming apparatus 2 includes a display 21, a control panel 22, a printer 23, a sheet accommodating unit 24, and an image reading unit 25. The printer 23 of the image forming apparatus 2 may be an apparatus for fixing a toner image, or may be an ink jet apparatus.

The image forming apparatus 2 forms an image on a sheet using a developer such as toner. The sheet is, for example, paper or label paper. The sheet may be anything as long as it is a material on which the image forming apparatus 2 can form an image on the surface thereof.

The display 21 is an image display apparatus such as a liquid crystal display or an organic electro luminescence (EL) display. The display 21 displays various information items related to the image forming apparatus 2. The various types of information are, for example, information indicating the number of sheets on which an image is formed, and message information transmitted from the post-processing apparatus 3. The message information is, for example, information that warns that an object that enters inside the post-processing apparatus 3 is detected. The display 21 may include a speaker. The display 21 may output a warning sound from the speaker based on the message information indicating a warning.

The control panel 22 includes a plurality of buttons. The control panel 22 receives an operation input of a user. The control panel 22 outputs a signal in accordance with the operation by the user to a control unit of the image forming apparatus 2. The display 21 and the control panel 22 may be integrally configured as a touch panel.

The printer 23 forms an image on a sheet based on the image information generated by the image reading unit 25. The printer 23 may form an image on a sheet based on the image information (online data) received via a communication channel. For example, the printer 23 forms an image using the following process. The image forming unit of the printer 23 forms an electrostatic latent image on a photosensitive drum based on the image forming information. The image forming unit of the printer 23 causes a developer to adhere to the electrostatic latent image to form a visible image. An example of the developer includes toner.

A transfer unit of the printer 23 transfers the visible image to the sheet. A fixing unit of the printer 23 performs heating and pressurizing of the sheet to fix the transferred visible image on the sheet. The sheet in which the image is formed may be a sheet accommodated in the sheet accommodating unit 24 or a sheet manually supplied to the image forming apparatus 2. The sheet accommodating unit 24 accommodates sheets to be used for image formation in the printer 23.

The image reading unit 25 reads image information to be read based on the relative brightness and darkness thereof. The image reading unit 25 outputs the read image to the printer 23. The image according to the read image information is formed on the sheet by the printer 23. The image reading unit 25 may output the read image information to other information processing apparatus via the network.

The post-processing apparatus 3 is an apparatus that performs a post-process on a plurality of sheets conveyed from the image forming apparatus 2.

Figure 2:
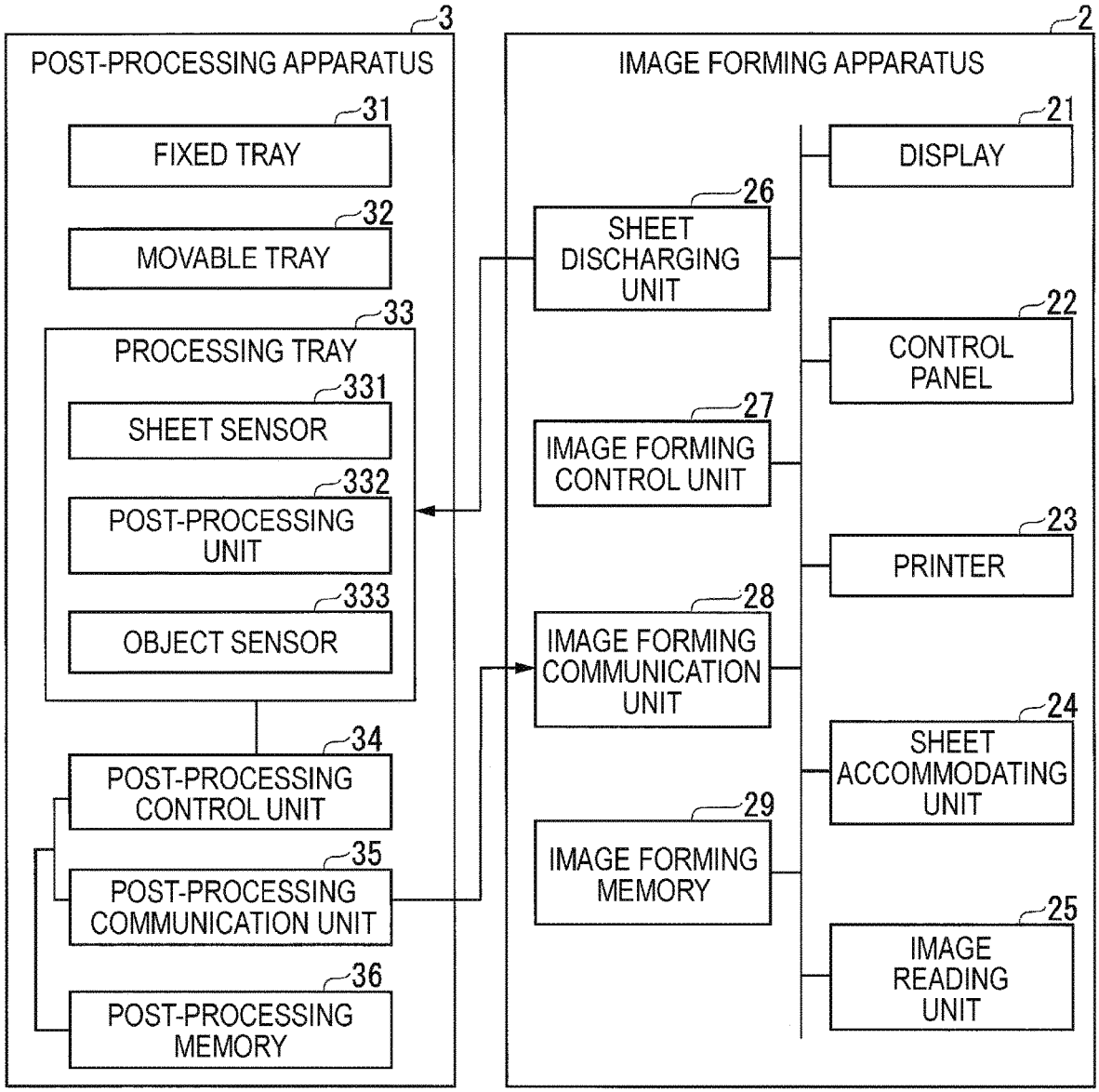
FIG. 2 is a block diagram showing an example of the configuration of the image forming system.

FIG. 2 is a block diagram showing an example of the configuration of the image forming system 1 according to the embodiment. The image forming apparatus 2 includes the display 21, the control panel 22, the printer 23, the sheet accommodating unit 24, the image reading unit 25, a sheet discharging unit 26, an image forming control unit 27, and an image forming communication unit 28, and an image forming memory 29.

A part or the entirety of the image forming control unit 27 and the image forming communication unit 28 is realized by software by causing a processor such as a central processing unit (CPU) to execute a program stored in the image forming memory 29. For example, a part or the entirety of the image forming control unit 27 and the image forming communication unit 28 may be realized using hardware such as large scale integration (LSI).

The sheet discharging unit 26 conveys the sheet discharged from the printer 23 to the post-processing apparatus 3. When the message information is transmitted from the post-processing apparatus 3 to the image forming apparatus 2, the sheet discharging unit 26 may temporarily stop the process of conveying the sheet to the post-processing apparatus 3. The image forming control unit 27 controls the operation of each component of the image forming apparatus 2. For example, the image forming control unit 27 controls the printing operation of the printer 23.

When the image forming apparatus 2 executes an online job, the image forming communication unit 28 receives image information via a communication channel. The image forming communication unit 28 outputs the received image information to the printer 23. The image forming communication unit 28 receives the message information transmitted from the post-processing apparatus 3. The message information indicates, for example, that an object enters an opening of the post-processing apparatus 3. The image forming communication unit 28 outputs the message information to the image forming control unit 27. The image forming communication unit 28 may output the message information to the display 21.

The image forming memory 29 is, for example, a non-volatile recording medium (non-temporary recording medium) such as a flash memory. The image forming memory 29 stores, for example, an image forming program. The image forming memory 29 may include a volatile recording medium such as, for example, a dynamic random access memory (DRAM).

The post-processing apparatus 3 includes a fixed tray 31, a movable tray 32, a processing tray 33, a post-processing control unit 34, a post-processing communication unit 35, and a post-processing memory 36. A part or the entirety of the post-processing control unit 34 and the post-processing communication unit 35 is realized by software by causing a processor such as a CPU to execute an image forming program stored in the image forming memory 29. Apart or the entirety of the post-processing control unit 34 and the post-processing communication unit 35 may be realized using hardware such as an LSI, for example.

The fixed tray 31 is a tray fixed to the upper portion of the post-processing apparatus 3. The fixed tray 31 holds the sheet discharged from the post-processing apparatus 3 at the upper portion of the post-processing apparatus 3. The movable tray 32 is a tray that moves upward or downward on the side surface of the post-processing apparatus 3. The movable tray 32 holds the sheet discharged from the post-processing apparatus 3 on the side surface of the post-processing apparatus 3.

The processing tray 33 (driving unit) is an area in the post-processing apparatus 3 where a post-process is performed on a sheet. The processing tray 33 may generate a bundle of sheets conveyed from the image forming apparatus 2 (hereinafter, referred to as "sheet bundle"). The processing tray 33 performs a post-process on the sheet bundle. The processing tray 33 includes a sheet sensor 331, a post-processing section 332, and a plurality of object sensors 333.

The sheet sensor 331 (outlet sensor) is a sensor that detects a sheet conveyed from the image forming apparatus 2. The object sensor 333 is, for example, a reflective type optical sensor. The sheet sensor 331 is provided in apart of the sheet conveyance path in the processing tray 33. For example, the sheet sensor 331 is provided at a position where the sheet immediately after being conveyed from the image forming apparatus 2 can be detected in the sheet conveyance path of the processing tray 33.

The post-processing section 332 (stapling unit) performs a post-process on the sheet bundle. The post-processing section 332 holds the sheet bundle until the post-processing is completed. The post-processed sheet bundle is discharged to the movable tray 32.

The object sensor 333 is a sensor that detects an object, and is, for example, a reflective type optical sensor. The object to be detected is, for example, a hand. The plurality of object sensors 333 are arranged on a ceiling inside the processing tray 33 so as to be distributed in a predetermined range from a position close to the opening of the processing tray 33 to a position far from the opening. That is, the plurality of object sensors 333 are disposed on the ceiling inside the processing tray 33 so as to be distributed in a predetermined range from the downstream to the upstream of the sheet conveyance direction. Thus, when an object enters inside the processing tray 33, the object sensor 333 can detect the entered object.

The post-processing control unit 34 controls the operation of each functional unit of the post-processing apparatus 3. For example, the post-processing control unit 34 controls the operation of sheet conveyance processing in the post-processing apparatus 3. The post-processing control unit 34 controls the post-process operation performed by the post-processing section 332.

The post-processing control unit 34 determines whether or not an object enters inside the processing tray 33 based on the order in which the respective object sensors 333 detect the object. When the downstream object sensor 333 in the sheet conveyance direction in the processing tray 33 detects an object before the upstream object sensor 333 detects the object in the processing tray 33, the post-processing control unit 34 determines that the object enters inside the processing tray 33. When the post-processing control unit 34 determines that the object enters inside the processing tray 33, the post-processing control unit 34 stops (cancels) the processing by the post-processing section 332. Further, the post-processing control unit 34 may stop the conveyance process in progress when it is determined that the object enters inside the processing tray 33. With these controls, the post-processing control unit 34 can reduce the possibility of occurrence of a failure due to the object entered inside the processing tray 33. Further, the post-processing control unit 34 may generate message information indicating a warning when it is determined that the object enters inside the processing tray 33. The post-processing control unit 34 restarts the post-process by the post-processing section 332 when the predetermined release condition is satisfied. The predetermined release condition is, for example, a condition that a predetermined time elapses since no object is detected inside the processing tray 33.

The post-processing communication unit 35 transmits the generated message information to the image forming communication unit 28. The post-processing memory 36 is, for example, a non-volatile recording medium (non-temporary recording medium) such as a flash memory. The post-processing memory 36 stores, for example, a post-processing program. The post-processing memory 36 may include a volatile recording medium such as a DRAM.

Figure 3:
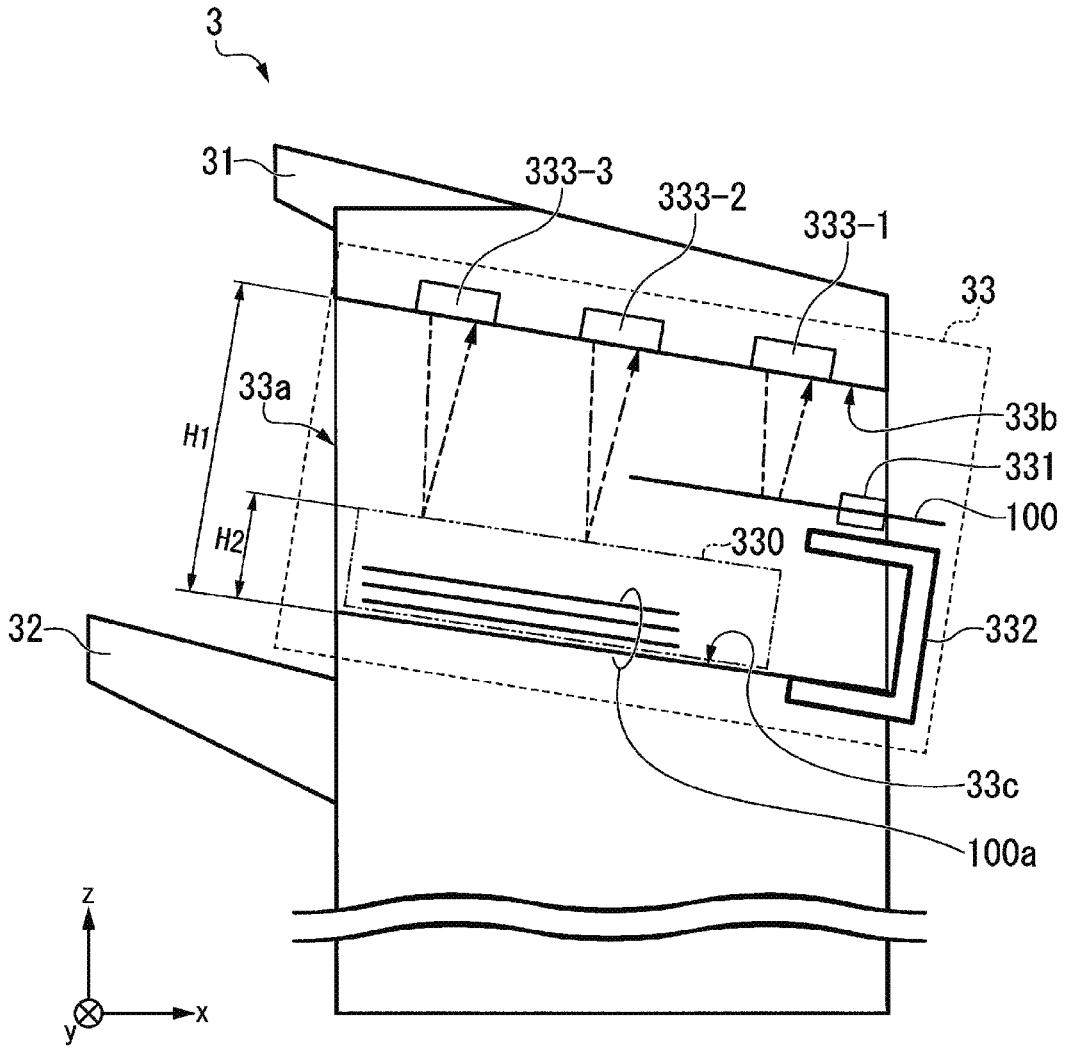
FIG. 3 is a view showing an example of the configuration of a post-processing apparatus.

FIG. 3 is a view showing an example of the configuration of the processing tray 33 according to the embodiment. The xyz axes are shown in FIG. 3 to simplify the description. In FIG. 3, the conveyance direction of a sheet 100 is the negative direction of the x-axis direction. An opening 33*a* is provided on the negative side of the x-axis direction in the processing tray 33. That is, the opening 33*a* is provided on the downstream side of the processing tray 33 in the conveyance direction of the sheet 100. A height "H1" of the opening 33*a* represents a distance from a ceiling surface 33*b* (first reference surface) of the processing tray 33 to a floor surface 33*c* (second reference surface). The width of the provided opening 33*a* is equal to or greater than the width of a sheet bundle 100*a*.

A holding area 330 is provided in the processing tray 33. The sheet bundle 100*a* is a bundle of sheets 100. The processing tray 33 generates the sheet bundle 100*a* in the holding area 330. The generated sheet bundle 100*a* is held in the holding area 330. A height "H2" of the holding area 330 represents the height according to the thickness and the maximum number of sheets 100. That is, the height "H2" of the holding area 330 represents the maximum height of the sheet bundle 100*a* with respect to the floor surface 33*c*. The maximum number of sheets of the sheet bundle 100*a* is, for example, 50.

The object sensor 333 detects an object at a position at a predetermined height or higher from the floor surface 33*c*. In FIG. 3, the focus of each object sensor 333 is set so that an object at a position at the height "H2" of the holding area 330 or higher inside the processing tray 33 can be detected. Thus, the object sensor 333 can detect an object in a range of the height "H2" or higher from the floor surface 33*c* and the height "H1" or lower from the floor surface 33*c*.

The sheet bundle 100*a* is held in the holding area 330 until a predetermined number of sheets 100 are bundled, and is then conveyed to the post-processing section 332. The post-processing section 332 performs a post-process on the sheet bundle 100*a*. The post-processed sheet bundle 100*a* is discharged to the movable tray 32 from the opening 33*a*.

Figure 4:
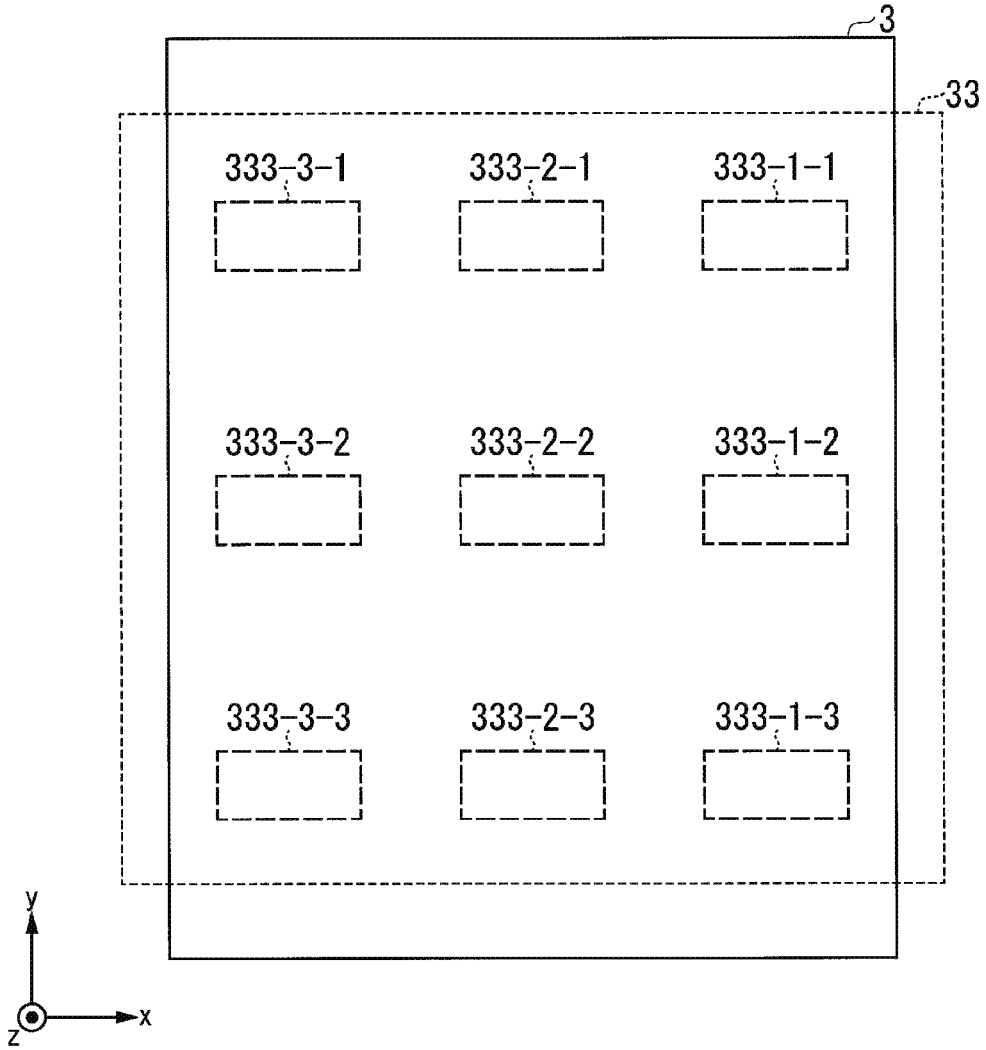
FIG. 4 is a view showing an example of arrangement of an object sensor.

FIG. 4 is a view showing an example of arrangement of the object sensor 333 according to the embodiment. The xyz axes are shown in FIG. 4 to simplify the description. The number of object sensors 333 is not limited to nine as illustrated in FIG. 4 as long as the number is two or more. In FIG. 4, a total of nine object sensors 333 in three rows in the x-axis direction and three rows in the y-axis direction are disposed on the ceiling inside the processing tray 33.

The plurality of object sensors 333 may be transmission type light sensors. The plurality of transmission type light sensors may be arranged so that the light emitting side and the light receiving side face each other in the y-axis direction (horizontal direction) inside the processing tray 33. Furthermore, the plurality of transmission type light sensors may be arranged at positions where the light emitting side and the light receiving side are higher than the height "H2" inside the processing tray 33. When the object sensor 333 is a transmission type light sensor, some of the members of the processing tray 33 may be provided with a hole for transmitting the light of the transmission type light sensor.

Figure 5:
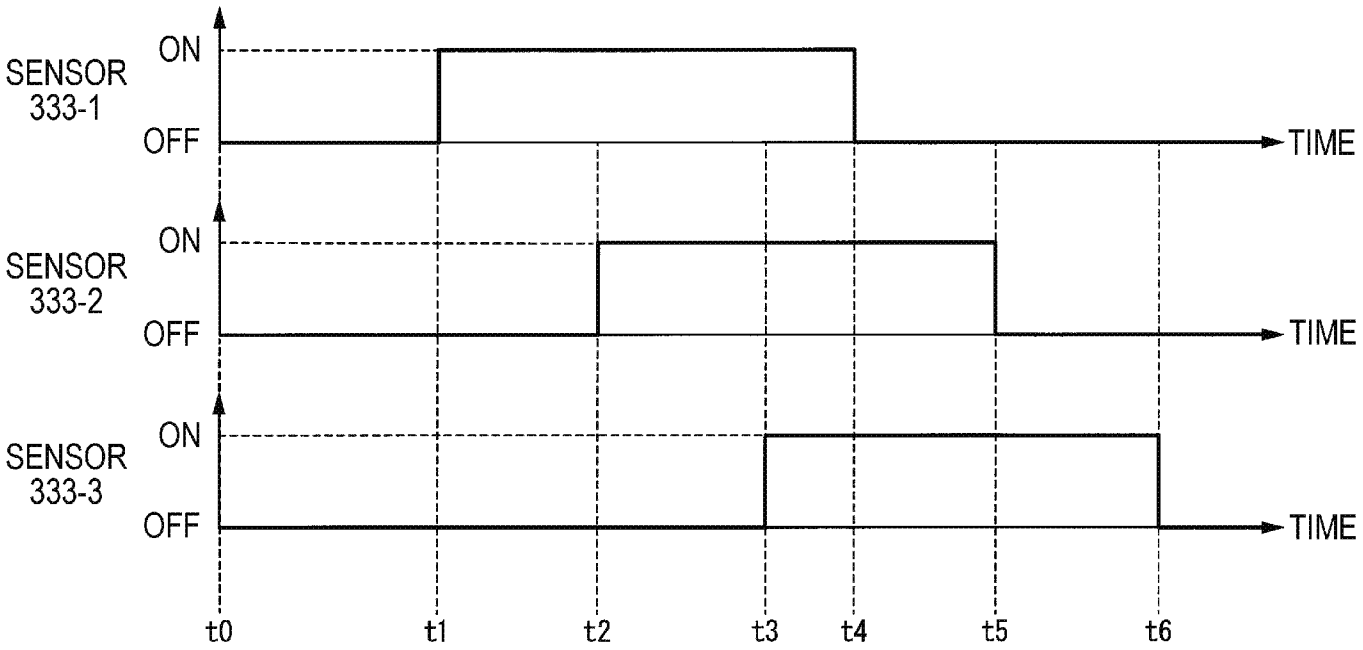
FIG. 5 is a view showing a first example of an object detection order.

FIG. 5 is a view showing a first example of an object detection order according to the embodiment. In the example shown in FIG. 5, the object does not enter inside the processing tray 33 through the opening 33*a*. In this case, the object sensor 333 arranged at a position far from the opening 33*a* detects the sheet 100 before the object sensor 333 arranged at a position close to the opening 33*a* detects the sheet 100. That is, each object sensor 333 detects the sheet 100 being conveyed in the conveyance direction in order from the upstream object sensor 333 to the downstream object sensor 333. When such a detection order result is obtained, the post-processing control unit 34 continues a normal conveyance process in progress.

In FIG. 5, an object sensor 333-1 detects the sheet 100 conveyed into the detection range of the object sensor 333-1 at time t1 before an object sensor 333-2 detects the sheet 100 conveyed in the detection range of the object sensor 333-2. The object sensor 333-2 detects the sheet 100 conveyed into the detection range of the object sensor 333-2 at time t2 before an object sensor 333-3 detects the sheet 100 conveyed in the detection range of the object sensor 333-3. The object sensor 333-3 detects the sheet 100 conveyed in the detection range of the object sensor 333-3 at time t3.

The object sensor 333-1 does not detect the sheet 100 conveyed outside the detection range of the object sensor 333-1 at time t4 before the object sensor 333-2 does not detect the sheet 100 conveyed outside the detection range of the object sensor 333-2. The object sensor 333-2 does not detect the sheet 100 conveyed outside the detection range of the object sensor 333-2 at time t5 before the object sensor 333-3 does not detect the sheet 100 conveyed outside the detection range of the object sensor 333-3. The object sensor 333-3 does not detect the sheet 100 conveyed outside the detection range of the object sensor 333-3 at time t6.

Figure 6:
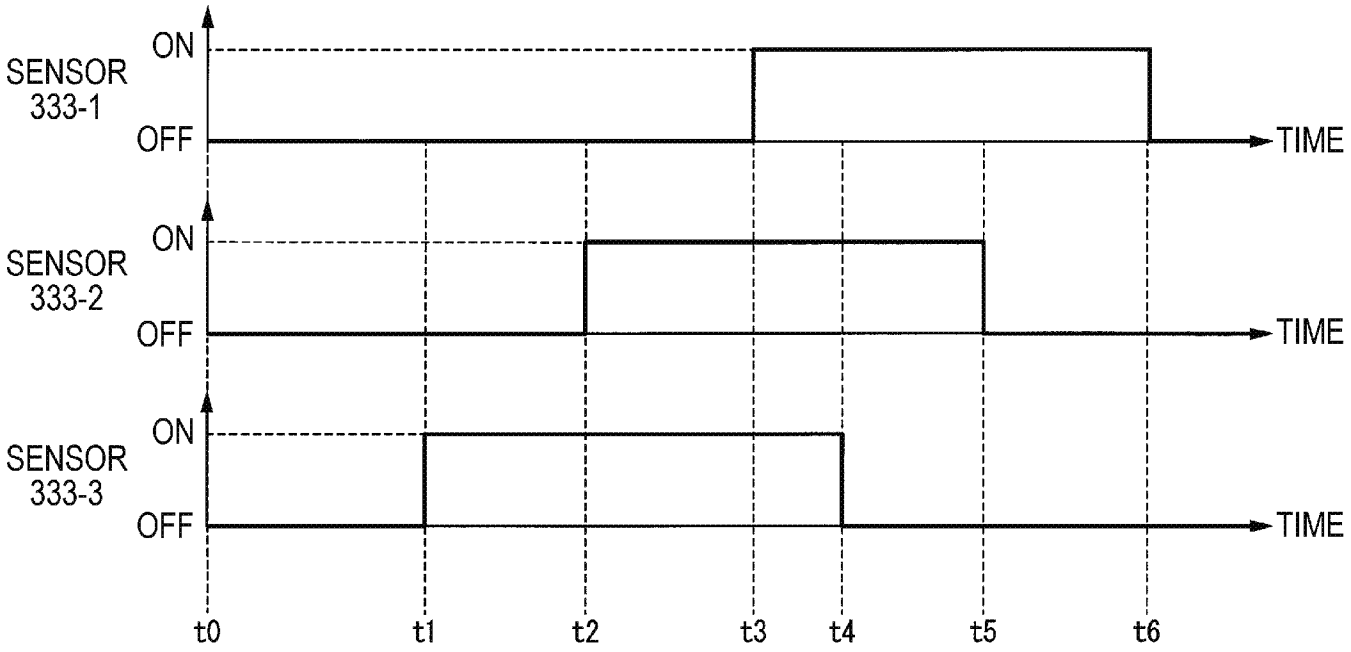
FIG. 6 is a view showing a second example of the object detection order.

FIG. 6 is a view showing a second example of the object detection order according to the embodiment. In the example shown in FIG. 6, the object enters inside the processing tray 33 through the opening 33*a*. In this case, the object sensor 333 arranged at a position close to the opening 33*a* detects the object before the object sensor 333 arranged at a position far from the opening 33*a* detects the object. That is, each object sensor 333 detects the object that enters inside the processing tray 33 in order of the downstream object sensor 333 and the upstream object sensor 333.

When the result of such detection order is obtained, the post-processing control unit 34 stops the normal conveyance process in progress. As a result, the post-processing control unit 34 can reduce the possibility of occurrence of a failure due to the entry of the object into the processing tray 33.

When the post-processing control unit 34 stops the normal conveyance process in progress, the post-processing communication unit 35 transmits message information representing a warning to the image forming communication unit 28 based on transmission processing control by the post-processing control unit 34. An image of the message information representing a warning is displayed on the display 21. The post-processing communication unit 35 may transmit message information representing a warning to an information processing terminal that transmits the image information to the image forming apparatus 2.

In FIG. 6, before the object sensor 333-2 detects the object that enters in the detection range of the object sensor 333-2, the object sensor 333-3 detects the object moved in the detection range of the object sensor 333-3 at the time t1. The object sensor 333-2 detects the object moved in the detection range of the object sensor 333-2 at the time t2 before the object sensor 333-3 detects the object that enters in the detection range of the object sensor 333-3. The object sensor 333-1 detects the object moved in the detection range of the object sensor 333-1 at the time t3.

The object sensor 333-3 does not detect the object moved outside the detection range of the object sensor 333-3 at the time t4 before the object sensor 333-2 does not detect the object that enters outside the detection range of the object sensor 333-2. Before the object sensor 333-3 does not detect the object that enters outside the detection range of the object sensor 333-3, the object sensor 333-2 does not detect the object moved outside the detection range of the object sensor 333-2 at the time t5. At the time t6, the object sensor 333-1 does not detect the object moved outside the detection range of the object sensor 333-1.

Next, an operation example of the image forming system 1 will be described.

Figure 7:
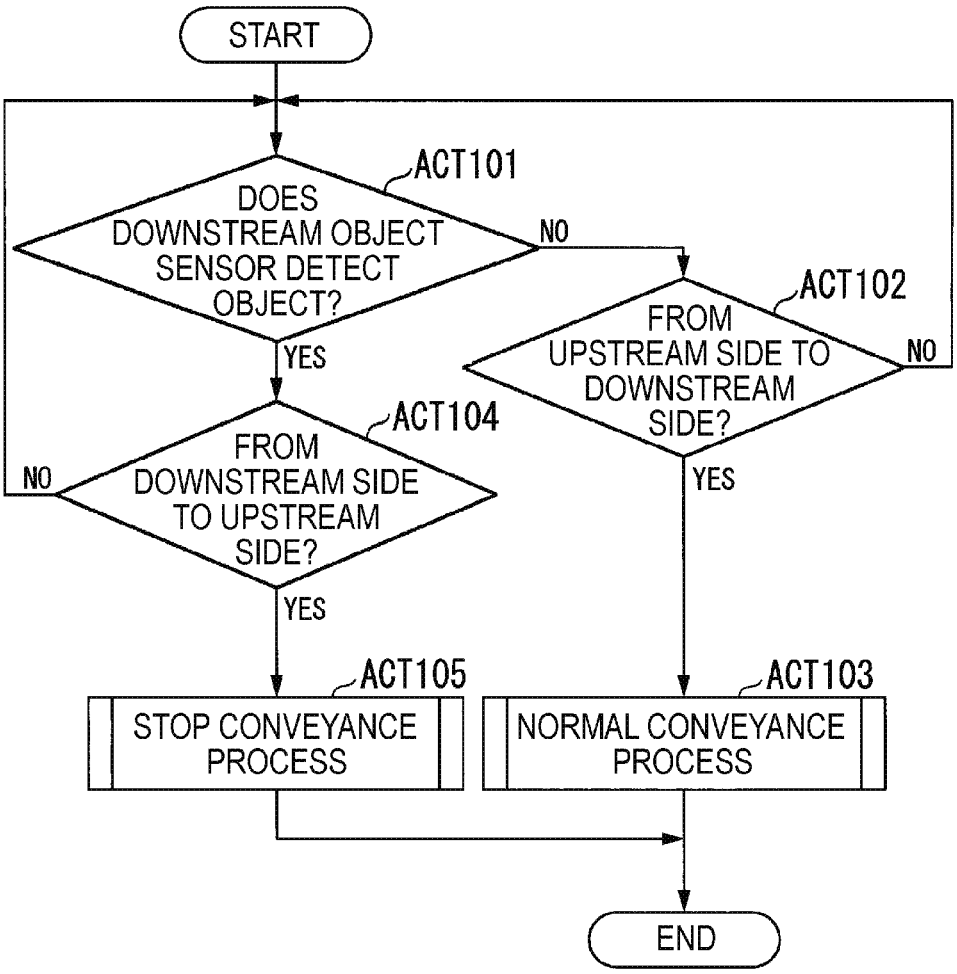
FIG. 7 is a flowchart showing an operation example of the image forming system.

FIG. 7 is a flowchart showing an operation example of the image forming system 1 according to the embodiment. The post-processing control unit 34 determines whether or not the downstream object sensor 333 in the conveyance direction of the sheet 100 detects the object (ACT 101). When the object sensor 333 other than the downstream object sensor detects the object (ACT 101: NO), the post-processing control unit 34 determines whether or not the object sensor 333 detects the object in order from the upstream side to the downstream side (ACT 102).

When it is determined that the object sensor 333 detects the object in order from the upstream side to the downstream side (ACT 102: YES), the post-processing control unit 34 continues the normal conveyance process in progress (ACT 103). The post-processing control unit 34 ends the process of the flowchart shown in FIG. 7.

When it is determined that the object sensor 333 detects the object in order other than the order from the upstream side to the downstream side (in random order) (ACT 102: NO), the post-processing control unit 34 returns the process to ACT 101.

When the downstream object sensor 333 detects the object (ACT 101: NO), the post-processing control unit 34 determines whether or not the object sensor 333 detects the object in order from the downstream to the upstream (ACT 104). When it is determined that the object sensor 333 detects an object in order other than the order from the downstream side to the upstream side (in random order) (ACT 104: NO), the post-processing control unit 34 returns the process to ACT 101.

When it is determined that the object sensor 333 detects an object in order from the downstream side to the upstream side (ACT 104: YES), the post-processing control unit 34 stops the conveyance process in progress. The post-processing communication unit 35 transmits the message information to the image forming communication unit 28 (ACT 105). The post-processing control unit 34 ends the process shown in the flowchart of FIG. 7.

As described above, the post-processing apparatus 3 according to the embodiment includes a first object sensor 333, a second object sensor 333, and the post-processing control unit 34. The first object sensor 333 is provided on the processing tray 33. The processing tray 33 is an area where a predetermined post-process is performed on the sheet bundle 100*a*. The post-processed sheet 100 passes through the opening 33*a* when the sheet is discharged from the processing tray 33. The first object sensor 333 detects an object in the processing tray 33. The second object sensor 333 detects an object at a position closer to the opening 33*a* in the processing tray 33 than the position of the first object sensor 333 with respect to the opening 33*a*. When the second object sensor 333 detects the object before the first object sensor 333 detects the object, the post-processing control unit 34 performs a predetermined process for preventing the occurrence of a failure. The predetermined process for preventing the occurrence of failure is, for example, a process of stopping a conveyance process of the sheet 100 halfway, a process of displaying a warning message on the display 21 of the image forming apparatus 2, a process of outputting a warning sound from at least one of the image forming apparatus 2 and the post-processing apparatus 3, or the like.

According to at least one embodiment described above, it is possible to prevent the occurrence of a failure when an object enters the opening of the post-processing apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A post-processing apparatus, comprising:

a first sensor that detects an object at a first position in a predetermined area in which a predetermined post-process is performed on a sheet conveyed from an image forming apparatus;

a second sensor that detects the object at a second position closer to an opening in the predetermined area than the first position with respect to the opening through which the sheet passes when the post-processed sheet is discharged from the predetermined area; and a control unit that performs a predetermined process for preventing an occurrence of a failure when the second sensor detects the object before the first sensor detects the object.

2. The apparatus according to claim 1, wherein the second sensor detects the object at a position at a predetermined height or higher from a reference surface in the predetermined area.

3. The apparatus according to claim 2, wherein the predetermined height is a height corresponding to a thickness of the sheet and a maximum number of the sheets from a floor surface in the predetermined area.

4. The apparatus according to claim 1, wherein the predetermined process includes a process of stopping the predetermined post-process.

5. The apparatus according to claim 4, wherein the control unit restarts the predetermined post-process when a predetermined release condition is satisfied.

6. The apparatus according to claim 1, further comprising:
a stapler.

7. The apparatus according to claim 1, further comprising:
a plurality of first sensors arranged along a straight line perpendicular to a post-processed sheet conveyance direction and a plurality of second sensors arranged along a straight line perpendicular to a post-processed sheet conveyance direction.

8. The apparatus according to claim 1, wherein
the first sensor is positioned closer than the second sensor to a second opening between the post-processing apparatus and the image forming apparatus.

9. The apparatus according to claim 1, further comprising:
a post-processing communication unit configured to transmit a warning message to the image forming apparatus.

10. The apparatus according to claim 1, wherein
the predetermined area is a post-processing tray.

11. A post-processing method, comprising:
detecting an object at a first position in an area of a post-processing apparatus in which a predetermined post-process is performed on a sheet conveyed from an image forming apparatus;
detecting the object at a second position closer than the first position to an opening in the area, the opening is an opening through which the sheet passes when the post-processed sheet is discharged from the area; and
performing a predetermined process for preventing an occurrence of a failure when the object is detected at the second position before the object is detected at the first position.

12. The method according to claim 11, further comprising:
detecting the object at the second position at a predetermined height or higher from a reference surface in the area.

13. The method according to claim 12, wherein
the predetermined height is a height corresponding to a thickness of the sheet and a maximum number of the sheets from a floor surface in the area.

14. The method according to claim 11,
the predetermined process includes stopping the predetermined post-process.

15. The method according to claim 14, further comprising:
restarting the predetermined post-process when a predetermined release condition is satisfied.

16. The method according to claim 11, further comprising:
stapling a sheet bundle.

17. The method according to claim 11, further comprising:
using a plurality of first sensors arranged along a straight line perpendicular to a post-processed sheet conveyance direction to detect the object at the first position and a plurality of second sensors arranged along a straight line perpendicular to a post-processed sheet conveyance direction to detect the object at the second position.

18. The method according to claim 11, wherein
the first position is positioned closer than the second position to a second opening between the post-processing apparatus and the image forming apparatus.

19. The method according to claim 11, further comprising:
transmitting a warning message to the image forming apparatus.

20. A method of preventing failure during post-processing, comprising:
detecting an object at a first position in an area of a post-processing apparatus in which a predetermined post-process is performed on a sheet conveyed from an image forming apparatus;
detecting the object at a second position closer than the first position to an opening in the area, the opening is an opening through which the sheet passes when the post-processed sheet is discharged from the area; and
stopping post-processing when the object is detected at the second position before the object is detected at the first position.

* * * * *